US007627271B2

(12) United States Patent
Ookushi et al.

(10) Patent No.: US 7,627,271 B2
(45) Date of Patent: Dec. 1, 2009

(54) IMAGE FORMING APPARATUS INCLUDING DRIVE TRANSMISSION MEMBER INCLUDING GEARS AND SHAFTS

(75) Inventors: Hirofumi Ookushi, Ibaraki (JP); Masahiko Saito, Ibaraki (JP); Kenji Nakamura, Ibaraki (JP); Atsushi Onose, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 504 days.

(21) Appl. No.: 11/521,480

(22) Filed: Sep. 15, 2006

(65) Prior Publication Data

US 2007/0065181 A1 Mar. 22, 2007

(30) Foreign Application Priority Data

Sep. 16, 2005 (JP) ..... P2005-270077

(51) Int. Cl.
*G03G 15/08* (2006.01)

(52) U.S. Cl. ..... 399/222; 399/223; 399/228

(58) Field of Classification Search ..... 399/119, 399/222, 223, 228
See application file for complete search history.

(56) References Cited

U.S. PATENT DOCUMENTS 6,832,063 B2 * 12/2004 Ahn et al. ..... 399/223
7,177,573 B2 * 2/2007 Kimura et al. ..... 399/222
7,376,373 B2 * 5/2008 Kim et al. ..... 399/228

FOREIGN PATENT DOCUMENTS

JP 2002-278209 9/2002

* cited by examiner

*Primary Examiner*—William J Royer
(74) *Attorney, Agent, or Firm*—McGinn IP Law Group, PLLC

(57) ABSTRACT

An image forming apparatus includes: a photosensitive member; a plurality of development devices attachable to and detachable from a main body of the image forming apparatus, a motor; and a drive transmission member. Each development device includes a development roller for forming a toner image on a surface of the photosensitive member. The motor is rotatable forward and backward, for driving the development roller. The drive transmission member is disposed between the motor and the development roller. The drive transmission member includes a plurality of gears, a plurality of shafts and a plurality of one-way clutches. An air gap is provided in at least one engagement portion where the gears engage with the shafts.

6 Claims, 3 Drawing Sheets

IMAGE FORMING APPARATUS INCLUDING DRIVE TRANSMISSION MEMBER INCLUDING GEARS AND SHAFTS

CROSS-REFERENCE TO RELATED APPLICATIONS

This application is based on and claims the benefit of priority from the prior Japanese Patent Application No. 2005-270077, filed on Sep. 16, 2005; the entire contents of which are incorporated herein by reference.

BACKGROUND

1. Technical Field

The present invention relates to an image forming apparatus equipped with development device drive means.

2. Description of Related Art

As an image forming apparatus using an electrophotographic method, such as a copier or a printer, a single component development type image forming apparatus which, by pressing a development roller against a photosensitive member and rotating it, forms a toner inside a development device on the photosensitive member, has been known. Means which rotationally drives the development roller of the image forming apparatus is configured of a motor and a plurality of gears. In a color image forming apparatus which uses a plurality of colors, black, yellow, magenta and cyan, as it is necessary to move a plurality of development devices and press them against the photosensitive member, by using an electro-magnetic clutch or a one-way clutch as the drive means, the plurality of development devices are driven by one motor. (For example, JP-A-2002-278209)

SUMMARY

A gear provided on a main body side of the image forming apparatus, by engaging with a gear attached to the development roller, rotates in a direction in which the development roller is pressed against the photosensitive member. For this reason, when the development roller is retracted from the photosensitive member, it is necessary to either release the engagement between the gear on the main body side of the image forming apparatus and the gear of the development roller, or to free the rotation of the gear on the main body side of the image forming apparatus using the electro-magnetic clutch. Also, as a plurality of development devices is coupled with respect to one motor, a problem exists wherein a load of a gear train to other coupled development devices makes it impossible to remove the development devices when attaching and removing.

According to an aspect of the invention, a drive transmission member of a development device is equipped with a gear, a shaft and a one-way clutch. A space in which a rotation becomes free is provided in an engagement portion of the gear and the shaft, or in an engagement portion of the shaft and the gear.

According to the above-aspect, as well as enabling a reliable retraction of a development device from a photosensitive member without increasing a number of parts, it is possible to provide a low cost, high quality image forming apparatus. It is possible to reliably attach and detach the development device.

DESCRIPTION OF THE EMBODIMENTS

In a color image forming apparatus including a drive transmission member which rotationally drives a plurality of development devices by a single motor, which can rotate forward and backwards, the drive transmission member comprises a gear, a shaft and a one-way clutch and, as a retraction and an attachment/detachment of the development devices is possible by a provision of an air gap in the engagement portion of the gear and the shaft, a low-cost color image forming apparatus is actualized with a small number of parts. Hereafter, a description will be given of an embodiment.

Embodiment 1

Figure 1:
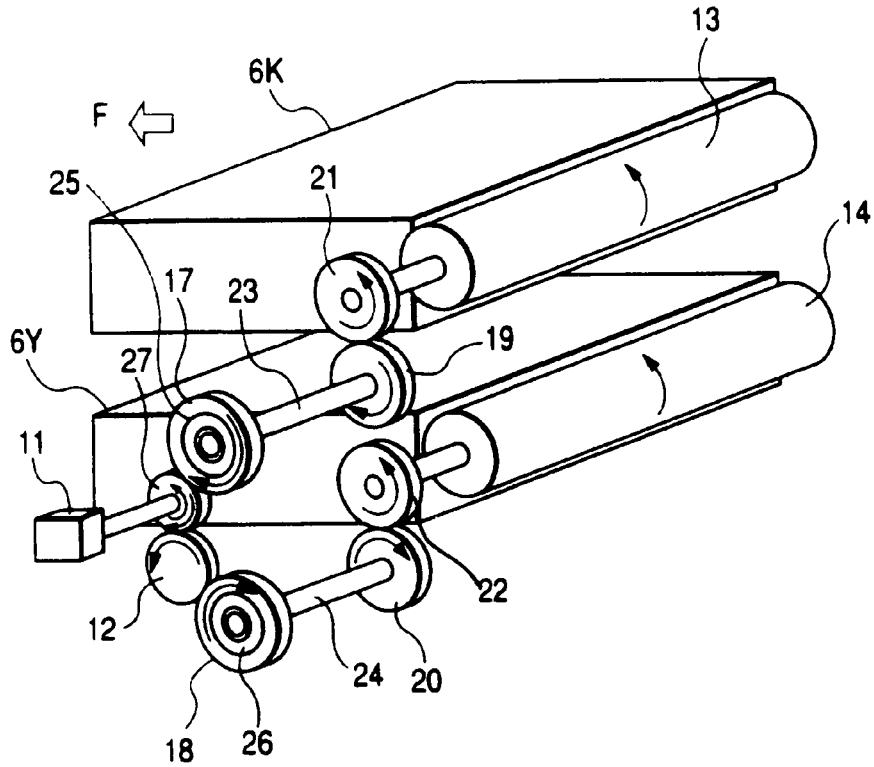
FIG. 1 is an exemplary schematic view of a drive transmission device according to an embodiment of the invention.

Hereafter, a description will be given of an embodiment of the invention using FIG. 1 and FIG. 2.

Figure 2:
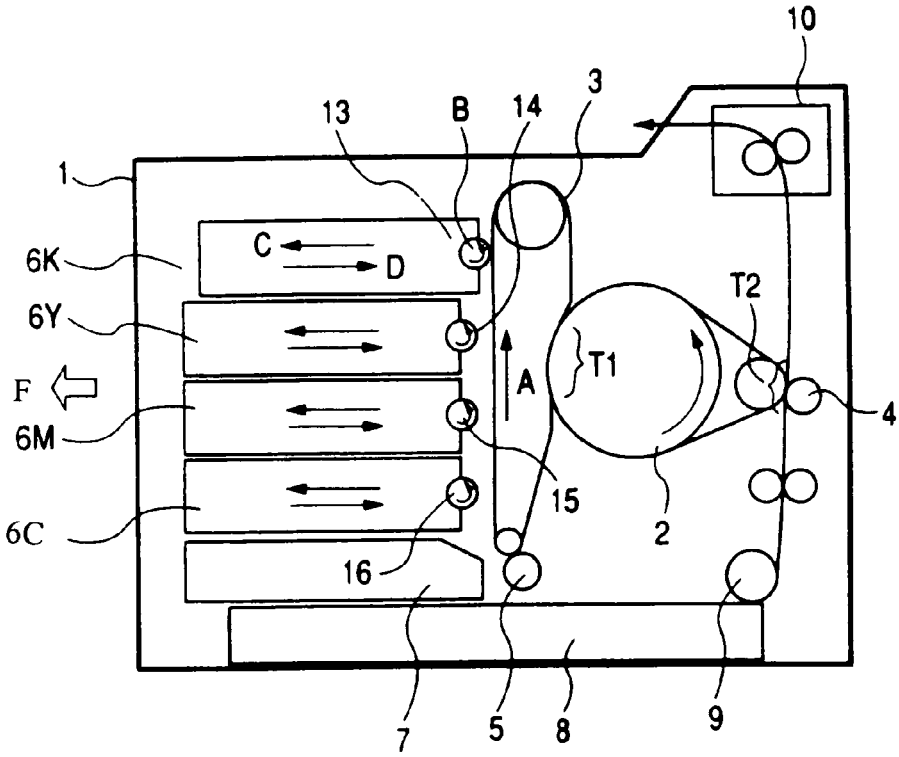
FIG. 2 is an exemplary schematic view of an image forming apparatus according to the embodiment.

FIG. 2 is a schematic view of an image forming apparatus 1, which is the embodiment. The apparatus 1 is a color laser printer which is capable of forming a color image by rotating an intermediate transfer body 2 four times, thereby superimposing four colors of image.

A description will be given of each unit disposed inside the image forming apparatus 1.

The intermediate transfer body 2 is disposed in a center of the apparatus 1, while a photosensitive member 3 and a transfer device 4 are disposed on a periphery of the intermediate transfer body 2. Also, a charger 5 is disposed on a periphery of the photosensitive member 3. Development devices 6K, 6Y, 6M and 6C, including development rollers 13, 14, 15 and 16 which contain four differing colors of toner and which rotate while making contact with the photosensitive member 3, each being unitized, are disposed in a stacked form in such a way as to make contact with and retract from the photosensitive member 3 in the direction of arrows C and D. The development devices 6K, 6Y, 6M and 6C shown in this embodiment use a one-component developer. An exposure device 7 is disposed below the development devices 6K, 6Y, 6M and 6C, while paper holding means 8, which stores paper, and a paper feeder 9, which feeds the paper one sheet at a time from the paper holding means 8, are disposed still further below. A fuser 10 is disposed at the top of the image forming apparatus 1. Next, a description will be given of an operation and a process of each unit. The photosensitive member 3 being of a belt type which rotates in the direction of an arrow A, its surface is uniformly charged by the charger 5.

Next, an exposure of an image and a letter information according to a personal computer, an image scanner and the like (not shown) is carried out in dot units by the exposure device 7, thus forming an electrostatic latent image on a surface of the photosensitive member 3. Subsequently, as the development device 6K moves in the direction of the arrow D by a not-shown solenoid or cam mechanism, the development roller 13 comes into contact with the photosensitive member 3. Then, as the development roller 13 is rotationally driven in the direction of the arrow B by a drive transmission member, to be described hereafter, a toner image is developed on the photosensitive member 3. The toner image developed on the photosensitive member 3 is transferred to a surface of the intermediate transfer body 2 by a first transfer portion T1. Subsequently, after the rotation of the development roller 13 has stopped, the development device 6K retracts in the direction of the arrow C in the figure. By the above process being repeated a necessary number of times by each of the development devices 6K, 6Y, 6M and 6C, a toner image corresponding to the image and letter information is formed on the surface of the intermediate transfer body 2. Subsequently, the toner image is transferred at a second transfer position T2, by the transfer device 4, onto the paper fed from the paper holding means 8 by the paper feeder 9. The paper onto which the toner image is transferred is conveyed to the fuser 10, the toner image is fused to the paper, and the paper is discharged by a paper discharger. In the image forming apparatus 1, as the development devices 6K, 6Y, 6M and 6C are expendables, they can be replaced by pulling in the direction opposite that of the photosensitive member 3, that is, in the direction of the arrow C in the figure.

Next, a description will be given of a drive device of the development devices 6K 6Y, 6M and 6C according to the embodiment. FIG. 1 is a perspective view of a drive transmission device which actualizes the rotation of the development rollers 13 and 14 of the development devices 6K and 6Y. Also, the rotational drive of the two development rollers 13 and 14 is executed by the forward rotation and backward rotation of one motor. FIG. 1 represents the drive transmission device of the development rollers 13 to 16 in FIG. 2. Consequently, as there are four development devices 6K, 6Y, 6M and 6C in the image forming apparatus 1 in FIG. 2, it follows that there are two systems of the drive transmission device shown in FIG. 1.

The drive transmission device has two systems of gear train for driving the development rollers 13 and 14 with respect to a development device drive motor 11, which is capable of forward rotation and backward rotation. The development roller 13, being disposed on an end of the development device 6K, is coupled to a development device gear 21, the gear 21 drives the development roller 13. The development device drive motor 11 is affixed to the main body of the image forming apparatus 1, while a motor gear 27 is attached to its tip. A configuration is such that a driving force of the motor gear 27 is transmitted to a development device drive gear 19 by an intermediate gear 17 and a shaft 23, which include a one-way clutch 25, and further transmitted to the development device gear 21. An air gap is provided in the engagement portion of the development device drive gear 19 and the shaft 23, as will be described hereafter, in order to enable the retraction, and pulling out and replacement, of the development device 6K, the structure being such that the shaft 23 can rotate backwards at or below an idling torque of the one-way clutch 25. Also, the other development roller 14, being disposed on an end of the development device 6Y, is coupled to a development device gear 22, the gear 22 drives the development roller 14. An idler gear 12 is included in the main body of the image forming apparatus 1, in order to make a rotation direction of the motor gear 27 and the development roller 14, which are coupled to the development device drive motor 11, the same as that of the development roller 13. The main body of the image forming apparatus 1 also, in order to transmit the drive of the development device drive motor 11 to the development device gear 22, includes, as the drive transmission member, an intermediate gear 18, which includes a one-way clutch 26, and a development device drive gear 20, which are coupled by a shaft 24. An air gap is provided in the engagement portion of the development device drive gear 20 and the shaft 24, as will be described hereafter, in order to enable the retraction, and pulling out and replacement, of the development device 6Y, the structure being such that the shaft 24 can rotate backwards at or below an idling torque of the one-way clutch 26.

In the embodiment, a one-way clutch manufactured by Origin Electric Co., Ltd. (model OWC612GXLZ), which can rotate backwards at or below a torque of 3 mN·m, is used, the reason for which will also be described.

Next, a description will be given of an operation of the drive transmission member. When the development device drive motor 11 rotates forward, the one-way clutch 25 of the intermediate gear 17, which is transmission means, is affixed, the development device drive gear 19 coupled to the intermediate gear 17 and the shaft 23 rotates in the direction of the arrow, and the development roller 13 rotates in the direction of the arrow via the development device gear 21. At this time, as the one-way clutch 26 of the intermediate gear 18 is released, the drive of the development device drive motor 11 is not transmitted to the other development roller 14, so the development roller 14 does not rotate. When the development device drive motor 11 rotates backwards, opposite to the previous description, the one-way clutch 26 of the intermediate gear 18 is affixed, the development device drive gear 20 coupled to the intermediate gear 18 and the shaft 24 rotates in the direction of the arrow, and the development roller 14 rotates in the direction of the arrow via the development device drive gear 20. At this time, as the one-way clutch 25 of the intermediate gear 17 is released, the drive of the development device drive motor 11 is not transmitted to the other development roller 13, so the development roller 13 does not rotate.

Figure 3A:
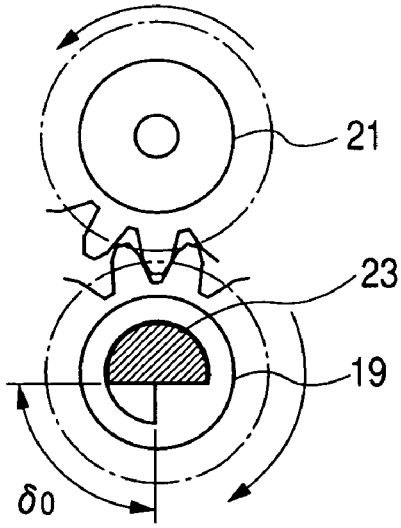
FIGS. 3A-3C are exemplary illustrations showing an engagement condition of a shaft and a gear according to the embodiment.
Figure 3B:
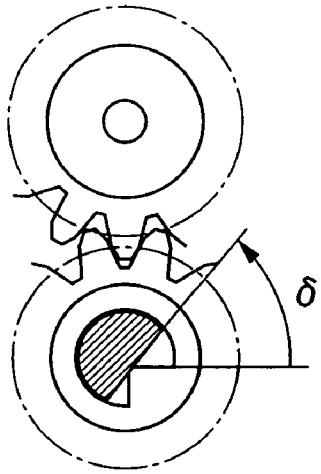
Figure 3C:
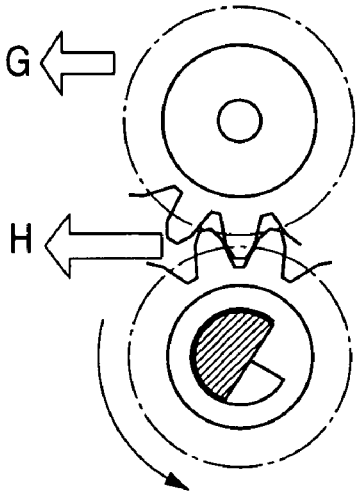

Next, a description will be given of a retraction mechanism of the development devices 6K, 6Y, 6M and 6C according to the embodiment. As shown in FIG. 1, in the event that the development device 6K is retracted, or pulled out and replaced, in the direction opposite to the photosensitive member 3, that is in an F direction, the development device drive gear 19 and the development device gear 21 are in engagement with each other, as a result of which, it is necessary to free the rotation of the development device drive gear 19 or the development device gear 21. Also, to prevent an irregular rotation of the development roller 13 due to backlash, a small module helical gear, which has a higher engagement rate than a spur gear, is normally used for the gears. The reason for this is that in the event of backlash, an irregular rotation of the development roller 13 will occur, causing a jittering of the image. In this embodiment, a gear of a module 0.5, a helical angle 23 and a tooth number 34 is used. Consequently, depending on an amount of gear backlash, it is not possible to release the engagement between the development device drive gear 19 and the development device gear 21 simply by freeing the rotation of the development device drive gear 19. Also, as in this configuration, in the event that the rotation direction in which the driving force is transmitted when the one-way clutch 25 is affixed, and the direction of a force acting on the development device drive gear 19 when the development device 6K is retracted, or pulled out and replaced, from the photosensitive member 3 is the same, as a gear train load from the development device drive motor 11 to the development device 6K is added, it is not possible to pull out and replace the development device 6K, and it is necessary to release the engagement between the development device drive gear 19 and the development device gear 21. In the embodiment, therefore, as shown in FIGS. 3A-3C, the configuration is such that by providing an air gap in the engagement portion of the development device drive gear 19 and the shaft 23, no load is applied when the shaft 23 rotates backwards. For this reason, by causing the development device drive motor 11 to rotate backwards on the main body side, it is possible to rotate only the shaft 23 within a range of the air gap, as a result of which the rotation of the development device drive gear 19 is freed, thereby enabling the retraction, and pulling out and replacement, of the development device 6K.

Hereafter, a detailed description will be given.

FIGS. 3A-3C show an engagement condition of the development device drive gear 19 and the shaft 23, wherein FIG. 3A shows a condition in which the shaft 23 rotates forward, rotating the development device gear 21, FIG. 3B shows the shaft 23 rotating backwards, and FIG. 3C shows a condition in which the development device 6K starts to retract. The configuration is such that a projection is formed on an inner periphery of the development device drive gear 19 wherein, as the projection engages with the D-shaped shaft 23, an air gap $\delta_0$ is formed. FIG. 3A shows a condition wherein, as the D-shape of the shaft 23 is in contact with the development device drive gear 19, the rotational driving force of the shaft 23 is transmitted to the development device drive gear 19 whereby, as shown by the arrow in the figure, the shaft 23, the development device drive gear 19 and the development device gear 21 rotate. FIG. 3B shows a condition wherein, in order to retract the development device 6K from the photosensitive member 3, by causing the development device drive motor 11 on the main body side to rotate backwards, the shaft 23 rotates backwards in the direction of the arrow, whereby the D-shape of the shaft 23 is separated by the amount 6 from the projection of the development device drive gear 19. As previously described, as the one-way clutch 25 shown in FIG. 1 can rotate the shaft 23 in a backward direction in the event that the torque applied to the shaft 23 is of or below a certain value, it is possible for the shaft 23 to rotate in a backward direction until the D-shape comes into contact with the projection provided on the development device drive gear 19, that is, until the air gap $\delta$ becomes $\delta_0$. Consequently, when, as shown in FIG. 3C, the development device 6K is retracted from the photosensitive member 3, although a force, caused by the engagement with the development device gear 21, acts on the development device drive gear 19 in the direction of the arrow H in the figure, it is possible for the development device drive gear 19 to idle by the amount of the air gap 6 with respect to the shaft 23. As a result, the engagement between the development device gear 21 and the development device drive gear 19 is released, enabling the development device 6K to be retracted from the photosensitive member 3 in the direction of the arrow G. In the event that a value of the air gap $\delta_0$ is large, a response of the development device drive gear 19 to the forward rotation of the development device drive motor 11 worsens, as a result of which a writing position of an image according to the four colors of development device is misaligned, causing a color misalignment. Also, in the contrary event that a value of the air gap $\delta_0$ is small, a range in which the development device drive gear 19 rotates freely becomes narrow, the retraction of the development device 6K becomes incomplete and, in a worst case, a situation arises in which a user is unable to remove and replace the development device 6K, which is an expendable. For this reason, it is necessary that the air gap $\delta_0$ is greater than the distance by which the engagement between the development device drive gear 19 and the development device gear 21 is released. Consequently, with this in mind, in this embodiment, as the distance by which the gear engagement is released is 3 mm or more according to the specifications of the previously described gear, the range of the air gap $\delta_0$ is set at approximately 4 to 8 mm (approximately 30 to 60 degrees expressed as an angle). The value of the air gap $\delta_0$ can be set as desired according to a rotation speed of the motor and the gear specifications.

Heretofore, a description has been given of one embodiment of a drive transmission member which enables the retraction of a development device by a one-way clutch which transmits a rotation in a backward direction, and a shaft and a gear which include an air gap in the engagement portion. It is also acceptable that the engagement portion including the air gap described heretofore is in the shaft and gear on the development device side, that is, in the shaft of the development roller 13 and the development device gear 21 shown in FIG. 1, rather than on the image forming apparatus main body side.

Embodiment 2

Figure 4:
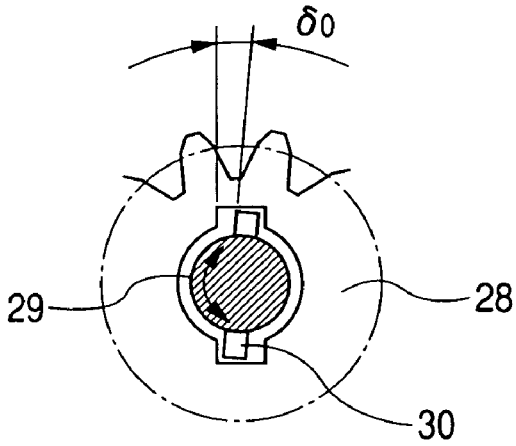
FIG. 4 is an exemplary illustration showing an engagement condition of a shaft and a gear according to another embodiment of the invention.

A description will be given, using FIG. 4, of another embodiment (embodiment 2) of an engagement condition of a shaft and gear according to the embodiment 2. A gear 28, being the development device drive gear 19 in FIG. 1, includes a recession in two places on an inner periphery. A shaft 29, being the shaft 23 which transmits a driving force of the development device drive motor 11, which rotates forward and backwards, in FIG. 1, includes the one-way clutch 25 in FIG. 1 on a not-shown opposite side. Also, a parallel pin 30 is attached to the shaft 29 wherein, as the parallel pin 30 engages with the recessions of the gear 28, an air gap $\delta_0$ is formed. Although generally, for reasons of low cost and lightness, a resin molded article made of polyacetal or PPS (polyphenylensulfide) is used for the gear 28, from the point of view of accuracy and strength, a metal is used for the shaft 29. For this reason, as there are two points of contact with the gear 28, it is possible to reduce an erosion of the recessions of the gear 28, which is molded from a resin.

It is possible to realize a long lifespan and a highly-reliable rotation with respect to the gear 28. Although in this embodiment the shaft 29 engages with recessions in two places, it is acceptable for there to be two or more places.

Embodiment 3

Figure 5:
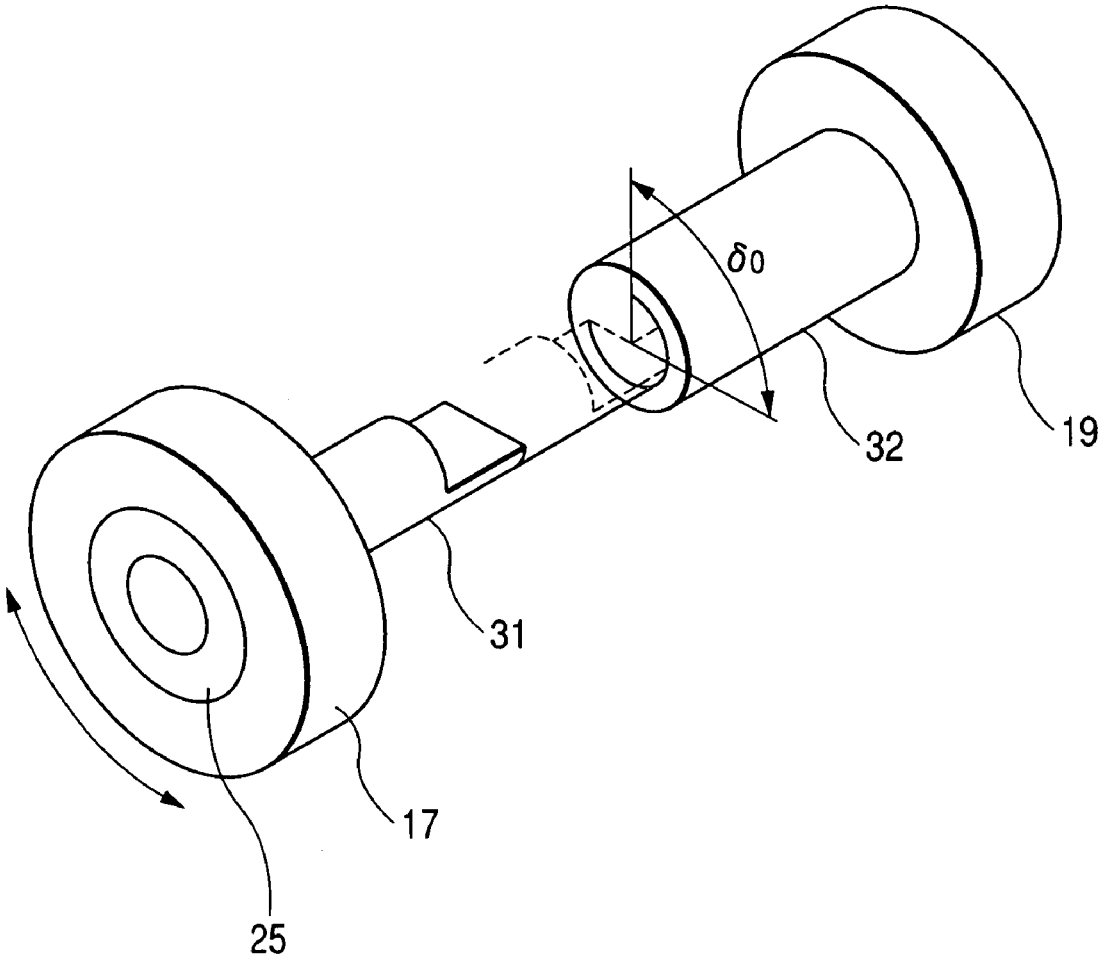
FIG. 5 is an exemplary schematic view showing a drive transmission device according to still another embodiment of the invention.

A description will be given, using FIG. 5, of still another embodiment (embodiment 3) of a drive transmission member including an air gap according to the embodiment 3. FIG. 5 shows a condition wherein the shaft 23 shown in FIG. 1 is coupled by two small shafts 31 and 32. That is, an intermediate gear 17, which rotates forward and backwards, as shown by the arrow in the figure, is attached to one side of the small shaft 31 via a one-way clutch 25, while the opposite side is of a D-shape. The shaft 32 is affixed to a development device drive gear 19 without an air gap, while having, on the opposite side, a hollow portion with a projection on an inner surface. Consequently, by aligning and engaging the D-shape of the small shaft 31 and the hollow portion of the small shaft 32, an air gap $\delta_0$ is formed. Also, for reasons of accuracy and strength, the small shafts 31 and 32 uses a metal as their material. Consequently, according to this embodiment, even though the D-shape of the small shaft 31 and the projection of the small shaft 32 repeatedly come into contact in the air gap $\delta_0$ due to the forward and backward rotation of the intermediate gear 17, it is possible to dramatically reduce an erosion thereof. It is possible to realize a highly-accurate and highly-reliable drive transmission.

Although the drive transmission member includes an Electro-magnetic clutch to free the rotation of the gear on the main body side of the image forming apparatus to enable the retraction of the development device, the electro-magnetic clutch has been expensive, and a number equal to the number of development devices has been necessary in the color image forming apparatus, meaning that a problem has existed regarding cost reduction.

According to the embodiments heretofore described, as well as enabling a reliable retraction of a development device from a photosensitive member without increasing a number of parts, it is possible to provide a low cost, high quality color image forming apparatus wherein it is possible to reliably attach and detach the development device.

What is claimed is:

1. An image forming apparatus comprising:

a photosensitive member;

a plurality of development devices attachable to and detachable from a main body of the image forming apparatus, each development device comprising a development roller for forming a toner image on a surface of the photosensitive member;

a motor rotatable forward and backward, for driving the development roller; and a drive transmission member disposed between the motor and the development roller, the drive transmission member comprising a plurality of gears, a plurality of shafts and a plurality of one-way clutches, wherein an air gap is provided in at least one engagement portion where the gears engage with the shafts.

2. An image forming apparatus according to claim 1, wherein a plurality of the air gaps are provided in the engagement portions of the gears and shafts.

3. An image forming apparatus according to claim 1, wherein the plurality of development devices comprises four development devices, and wherein the motor comprises two motors which each drive different development rollers.

4. An image forming apparatus according to claim 1, wherein the air gap is equal to or greater than a distance by which an engagement between a gear on a motor side and a gear on a development roller side is released.

5. An image forming apparatus comprising:

a photosensitive member;

a plurality of development devices attachable to and detachable from a main body of the image forming apparatus, each development device comprising a development roller for forming a toner image on a surface of the photosensitive member;

a motor rotatable forward and backward, for driving the development roller; and a drive transmission member disposed between the motor and the development roller, the drive transmission member comprising a plurality of gears, a plurality of shafts and a plurality of one-way clutches, wherein at least one shaft is a coupling of a small shaft, and wherein an air gap is provided in a coupling portion of the small shaft.

6. An image forming apparatus comprising:

a photosensitive member;

a plurality of development devices attachable to and detachable from a main body of the image forming apparatus, each development device comprising a development roller for forming a toner image on a surface of the photosensitive member;

a motor rotatable forward and backward, for driving the development roller;

a drive transmission member disposed between the motor and the development roller, the drive transmission member comprising a plurality of gears, a plurality of shafts and a plurality of one-way clutches; and a drive buffer releasing the engagement between the gears of the drive transmission member.

* * * * *